United States Patent [19]

Warner

[11] 4,296,988

[45] Oct. 27, 1981

[54] CONNECTOR WITH IMPROVED TERMINAL SUPPORT

[75] Inventor: Gary N. Warner, Harrisburg, Pa.

[73] Assignee: AMP Incorporated, Harrisburg, Pa.

[21] Appl. No.: 122,932

[22] Filed: Feb. 20, 1980

[51] Int. Cl.[3] ..... H01R 11/20
[52] U.S. Cl. ..... 339/97 R
[58] Field of Search ..... 339/97 R, 98, 99 R, 339/97 P

[56] References Cited

U.S. PATENT DOCUMENTS 4,153,326 5/1979 Frantz et al. ..... 339/99 R
4,159,158 6/1979 Weidler ..... 339/97 P

*Primary Examiner*—Eugene F. Desmond
*Attorney, Agent, or Firm*—F. Brice Faller

[57] ABSTRACT

Multi-contact electrical connector has an insulating housing having wire-in-slot type terminals therein which are received in cavities through the wire receiving end of the housing. Terminals have lateral projections which cooperate with support means in the housing to reinforce the terminal against stresses developed during wire insertion.

5 Claims, 5 Drawing Figures

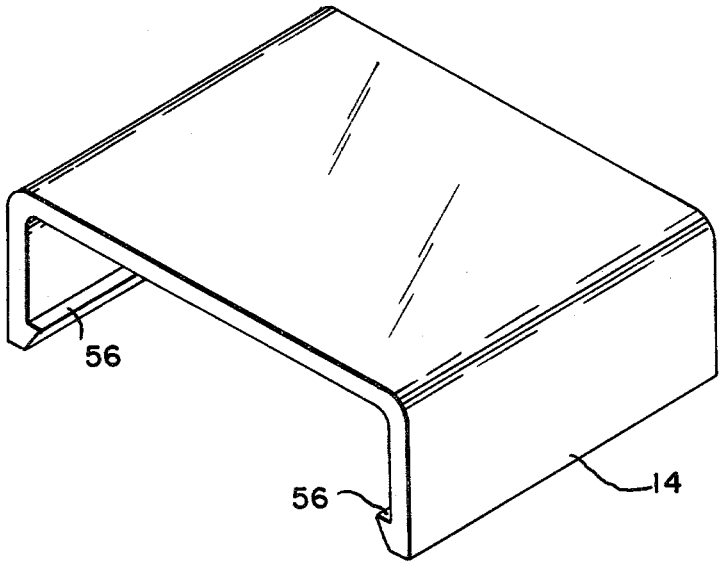
FIG. 2
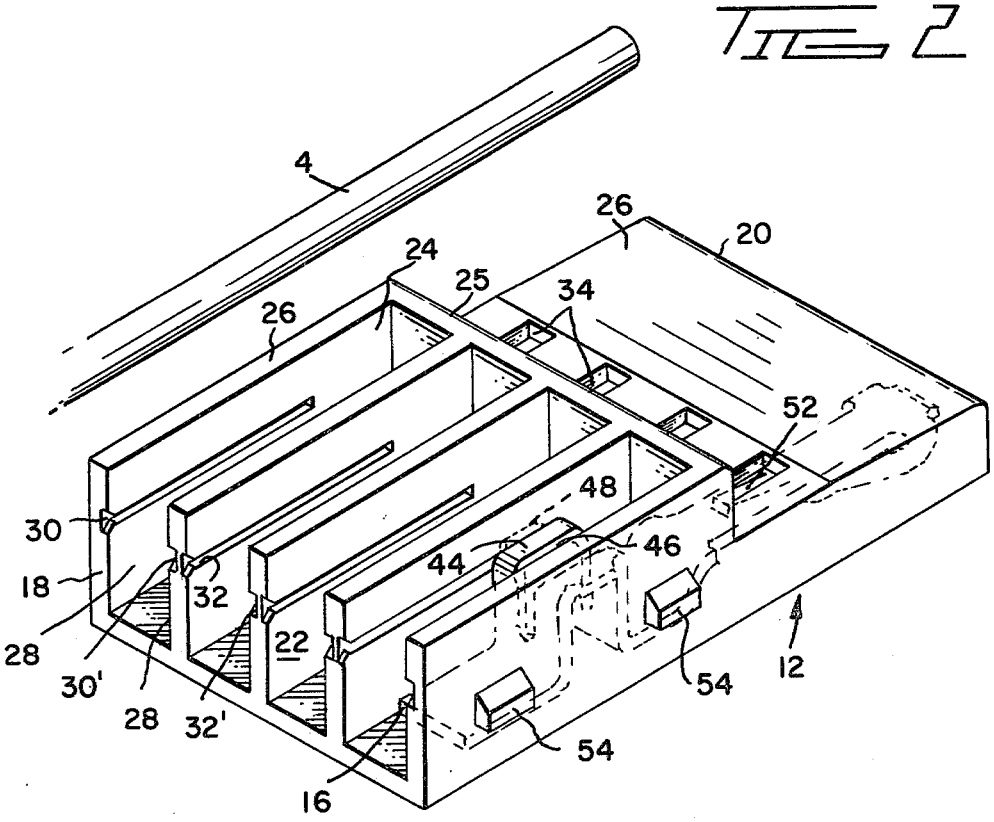

CONNECTOR WITH IMPROVED TERMINAL SUPPORT

BACKGROUND OF THE INVENTION

1. Field of the Invention

This invention relates to electrical connectors, particularly multi-contact electrical connectors, of the type having contact terminals therein which displace insulation about wires as they are moved laterally of their axes and into wire receiving slots.

2. The Prior Art

Insulation displacing connectors of the type having slots therein are well known. These offer the advantage that contact terminals may be preloaded in a connector housing, then individual conductors may be connected to the terminals by a relatively simple wire insertion operation. As a wire is inserted, substantial forces are imposed on the terminal as insulation is displaced and conductors are forced into undersized slots. The construction of the connector must account for these forces in order to prevent damage.

The insertion force problem becomes pronounced as the size of the terminal decreases, since thinner metal is used in the terminal to meet the size limitation, or thinner metal may be used to meet cost limitations. This problem is specifically addressed in U.S. Pat. No. 4,159,158, where shoulder surfaces are provided in the connector housing to support the terminal under the conductor receiving end thereof. This design, however, is only adapted to connectors where the wires enter at right angles to the axis of the housing.

SUMMARY

The instant invention provides a means of supporting a terminal in a connector of the type where wires run parallel to the axis of the housing. This is accomplished by having the wire receiving portion of the terminal adjacent to an opening in the side of the connector housing rather than the end thereof, and by providing flanges on the wire receiving portion which mate with grooves in the housing.

It is an object of the present invention to provide an improved electrical connector of the type where terminals are preloaded in a housing from the end thereof.

It is a further object to provide support means for the terminal which are effective against wire insertion forces in a small terminal, having the support means consistent with the object of preloading terminals in the housing from the end thereof.

BRIEF DESCRIPTION OF THE DRAWINGS

FIG. 2 is an exploded perspective view of a housing with terminal installed and a wire aligned for insertion therein and a cover aligned for assembly thereto.

DESCRIPTION OF THE PREFERRED EMBODIMENT

Figures 1, 3:
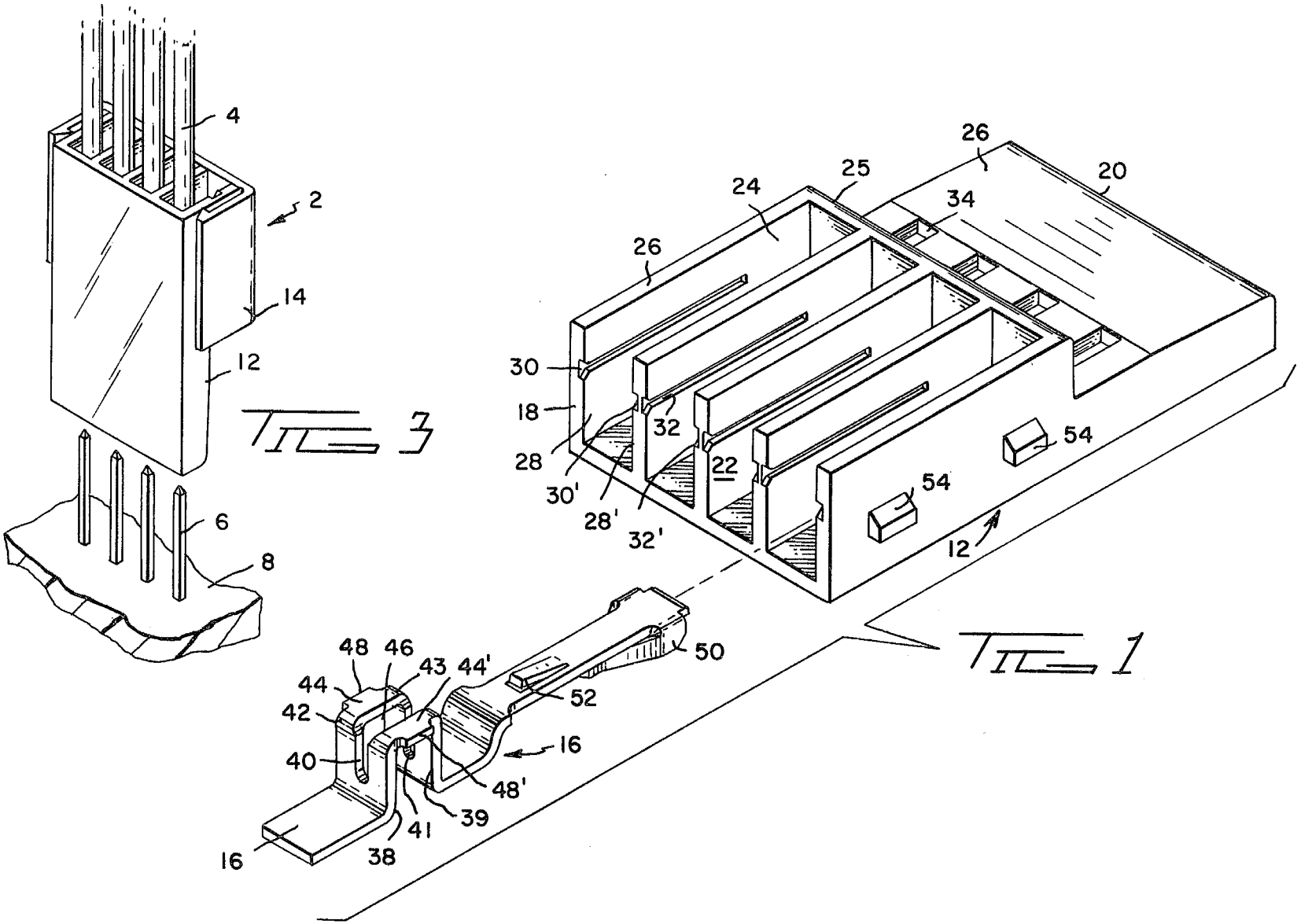
FIG. 1 is an exploded perspective view of a housing body and a contact terminal aligned for assembly therein.
FIG. 3 is a perspective view of a fully assembled connector aligned for mating with a row of terminal pins.
Figure 4:
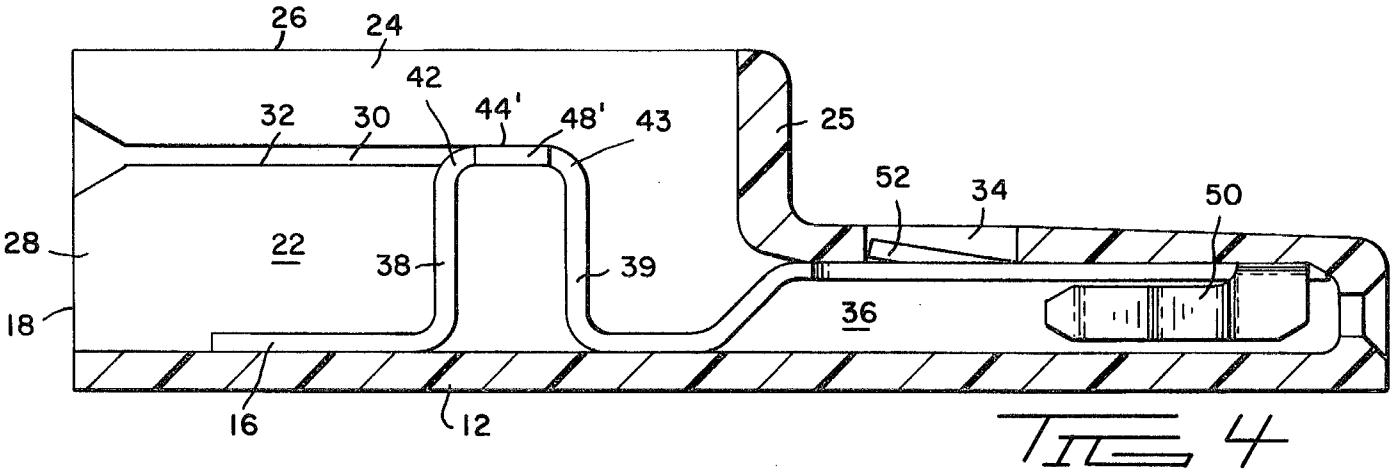
FIG. 4 is a cross-sectional view of a housing with contact terminal installed.

A connector assembly 2, FIG. 3, in accordance with the invention serves to connect wires 4 to terminal posts 6 arranged in a row on a circuit board or other panel member 8.

The connector assembly 2 comprises a housing 12 and a contact terminal 16, FIG. 1, and a housing cover 14, FIG. 2. Both the housing and cover are molded from insulating material such as nylon. The housing 12 has a wire receiving face 18 and a mating face 20. The wire receiving face 18 has a row of cavities 22 extending inwardly to the mating face 20 and parallel to the longitudinal axis of the connector. Each housing 12 has a row of wire admitting openings 24 extending from the wire receiving face 18 along one external sidewall 26 of the housing, one wire admitting opening 24 communicating with each cavity 22.

The cavities 22 each have a pair of opposed internal endwalls 28, 28' which are mirror images of each other and extend normally of external sidewall 26. Endwalls 28, 28' each have a groove 30, 30' extending inwardly from the wire receiving face 18, each groove defining a shoulder 32, 32' thereon which is in a plane generally parallel to the plane of sidewall 26. The wire admitting openings 24 extend only to barrier wall 25, where the external sidewall 26 is stepped down between the barrier wall 25 and the mating face 20. The section of external sidewall 26 between the barrier wall and the mating face has openings 34 therein, one opening 34 communicating with a receptacle portion 36 of each cavity.

The individual terminals 16 are designed for reception in the cavities via the wire receiving face 18 of the housing as shown in FIG. 1. The terminal 16 comprises an elongate piece of sheet metal which is folded to form parallel first and second plate-like members 38, 39 having first and second outer ends 42, 43 respectively. The plate-like members 38, 39 have first and second wire receiving slots 40, 41 therein respectively which extend inwardly from outer ends 42, 43 respectively. The outer ends 42, 43 are connected by spaced apart strap members 44, 44' which define an opening 46 therebetween which runs between slot 40 and slot 41. The strap members 44, 44' have a pair of opposed flanges 48, 48' respectively thereon which extend laterally outwardly therefrom in the plane of the strap members, which is normal to the plane of the plate-like members. Other salient features of the terminal include a retention lance 52 which protrudes from the surface of the elongate strip and a contact portion 50 at one end of the strip formed to mate with a terminal post 6.

In practice, a terminal 16 is inserted in a housing 12 by aligning it as shown in FIG. 1 and moving the terminal into a cavity 22 through the wire receiving face 18 of the housing. During insertion flanges 48, 48' ride on shoulders 32, 32' respectively while the contact portion 50 is received in the receptacle portion 36 of the cavity. When insertion is complete, the retention lance 52 snaps into opening 34 in the housing to lock the terminal in place.

Wire insertion is accomplished by aligning the components as shown perspectively in FIG. 2. The wire is moved laterally of its axis through the wire admitting openings 24 in the housing 12 and into the wire receiving slots 40, 41 in the plate-like members, passing through opening 46 between strap members 44, 44'.

The movement of the wires into the terminals imposes substantial loads on the terminals and these loads give rise to relatively high stresses in the terminal. Since the terminals are made of thin stock metal, for example, stock metal having a thickness of about 0.012 inches, such stresses can damage the terminal unless they are properly controlled. In accordance with the principles of the instant invention, however, the downwardly directed forces imposed on the terminal as the wire moves into the slots 40, 41 produce only isolated tensile stresses in the plate-like members 38, 39 and the spaced apart strap members 44, 44'. During insertion, a wire will impose a downwardly directed force on each of the plate-like members, but since the flanges 48, 48' are supported by shoulders 32, 32' respectively only tensile loading will result and the terminal will be protected from deformation which could result from compressive forces. After the wire is fully inserted, these tensional stresses are relieved.

In addition to downwardly directed forces discussed above the insertion of a wire also causes lateral forces on the edges of the wire receiving slots 40, 41 as insulation is displaced and electrical contact is made with the conductive core of the wire. These forces help prevent the flanges 48, 48' from slipping off shoulders 32, 32' and assure more positive overlap as the portions of the plate-like members on opposite sides of the slots flex outwardly to meet the internal endwalls 28, 28' of the cavity. The endwalls assist in providing opposition necessary to prevent too much lateral distention of the terminal during insertion. Once the wire is fully inserted, these lateral stresses remain, and must be maintained to assure good electrical contact.

Figure 5:
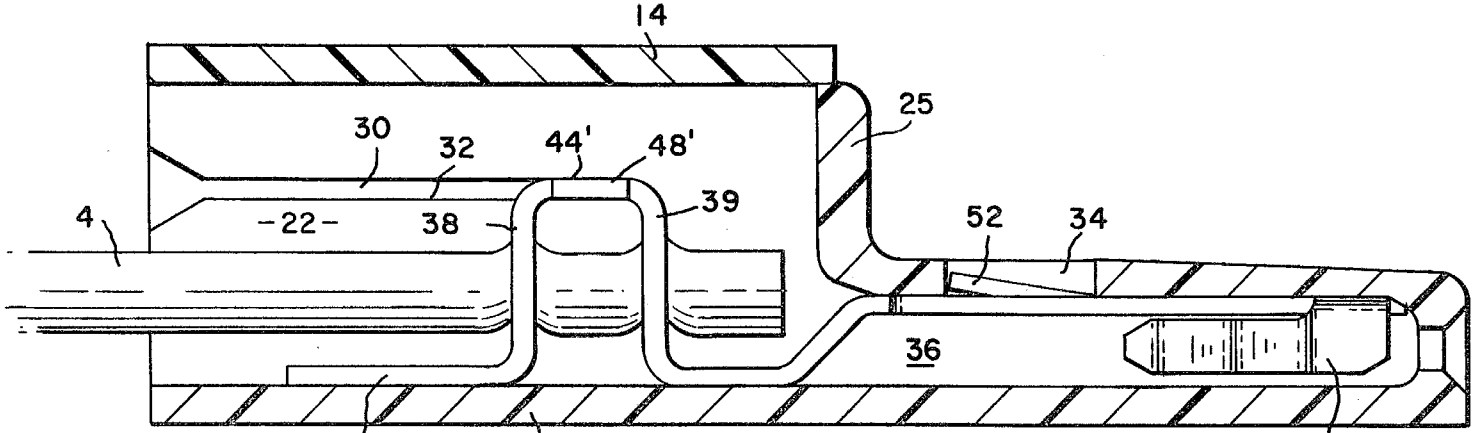
FIG. 5 is a cross-sectional view of an assembled connector.

Once the wire is inserted, the housing cover 14 is placed over the housing 12 until the lips 56 on opposing sides of the cover snap onto bosses 54 on the housing. The connector assembly 2, shown cross-sectionally in FIG. 5, is now ready for mating with terminal posts 2 on a panel member 8 as shown in FIG. 3.

It will be apparent that a wide variety of connectors can be made in accordance with the principles of the invention and that in all cases, manufacturing costs can be maintained at a minimum level because of the relative simplicity in both the housing and the terminal.

What is claimed is:

1. A pre-loaded electrical connector of the type comprising an insulating housing having a wire-receiving face and a cavity extending inwardly from said wire-receiving face, a wire admitting opening in said housing communicating with said cavity, said opening extending from said wire-receiving face partially along one external sidewall of said housing, said cavity having opposed internal endwalls extending normally of said one external sidewall, and an electrical contact terminal in said cavity, said terminal having wire-receiving means proximate to said wire-receiving face, said connector being characterized in that:

said wire-receiving means comprises at least one plate-like member disposed in said cavity at a location proximate to said wire-receiving face, said plate-like member being in a plane which extends substantially normally of said opposed internal endwalls and having an outer end which is proximate to said one external sidewall of said housing, a wire-receiving slot in said plate-like member extending inwardly from said outer end, each of said opposed internal endwalls of said cavity having a supporting shoulder which is in a plane generally parallel to the plane of said one external sidewall, each said shoulder extending from said wire-receiving face into said cavity to said plate-like member, said wire-receiving means having integral supporting projections extending laterally outwardly therefrom proximate said external sidewall and overlapping said shoulders, said terminal having been axially inserted into said cavity from said wire-receiving face whereby, upon locating a wire with its axis beside said one external sidewall in alignment with said wire admitting opening, and upon movement of said wire laterally of its axis, into said wire admitting opening and into said wire-receiving slot, said plate-like member is supported by said integral supporting projections and said member is stressed in tension.

2. An electrical connector as in claim 1 wherein said projections comprise a pair of opposed flanges.

3. An electrical connector as in claim 2 wherein said wire-receiving means comprises two plate-like members having their outer ends connected by a pair of spaced-apart strap members, said strap members defining an opening therebetween which extends between said wire-receiving slots, each said strap member having a flange thereon.

4. An electrical connector as in claim 1 wherein said endwalls each have a groove therein extending from said wire-receiving face into said cavity to said plate-like member, said supporting shoulders being defined by said grooves.

5. A pre-loaded electrical connector of the type comprising an insulating housing have a wire-receiving face and a cavity extending inwardly from said wire-receiving face, a wire admitting opening in said housing communicating with said cavity, said opening extending from said wire-receiving face partially along one external sidewall of said housing, said cavity having opposed internal endwalls extending normally of said one external sidewall, and an electrical contact terminal in said cavity, said terminal having wire-receiving means proximate to said wire-receiving face, said connector being characterized in that:

said wire-receiving means comprises two substantially parallel plate-like members disposed in said cavity substantially normal to said endwalls, each said plate-like member having an outer end proximate to said wire admitting opening in said external sidewall, and a wire-receiving slot extending inwardly from said outer end, said outer ends being connected by a pair of spaced apart strap members defining an opening therebetween which extends between said slots, each said strap member having a flange extending oppositely from said opening between said straps, each of said endwalls has a groove therein extending from said wire-receiving face into said cavity to beyond said plate-like members, said grooves lying in a plane parallel to the plane of said external sidewall and proximate thereto, said grooves defining shoulders which support said flanges, whereby, upon locating a wire with its axis beside said one external sidewall in alignment with said wire admitting opening, and upon movement of said wire laterally of its axis through said wire admitting opening, through said opening between said straps and into said wire-receiving slots, said plate-like members are supported by said flanges bearing against said shoulders and said plate-like members are stressed in tension.

* * * * *